US006090232A

United States Patent [19]

Seeliger et al.

[11] Patent Number: 6,090,232

[45] Date of Patent: Jul. 18, 2000

[54] COMPONENT MADE FROM A METALLIC FOAM MATERIAL

[75] Inventors: Hans-Wolfgang Seeliger, Osnabrueck; Winfried Bunsmann, Bissendorf, both of Germany

[73] Assignee: Wilhelm Karmann GmbH, Osnabrueck, Germany

[21] Appl. No.: 08/828,789

[22] Filed: Mar. 27, 1997

[30] Foreign Application Priority Data

Mar. 29, 1996 [DE] Germany ..... 196 12 781

[51] Int. Cl.[7] ..... B32B 5/18; B29C 65/00

[52] U.S. Cl. ..... 156/79; 264/42

[58] Field of Search ..... 428/613, 550, 428/553, 554, 307.3, 309.9, 319.9; 29/527.5; 164/47, 79; 156/79; 264/42, DIG. 36

[56] References Cited

U.S. PATENT DOCUMENTS

| | | | |
|---|---|---|---|
| 2,974,034 | 3/1961 | Fiedler et al. | 75/20 |
| 2,983,597 | 5/1961 | Elliott | 75/20 |
| 3,087,807 | 4/1963 | Allen et al. | 75/20 |
| 3,214,265 | 10/1965 | Fiedler | 75/20 |
| 3,719,223 | 3/1973 | Jarema et al. | 164/79 |
| 3,873,392 | 3/1975 | Niebylski et al. | 156/306 |
| 4,411,679 | 10/1983 | Pelton | 65/22 |
| 4,942,915 | 7/1990 | Kallen et al. | 164/34 |
| 5,151,246 | 9/1992 | Baumeister et al. | 419/2 |
| 5,281,251 | 1/1994 | Kenny et al. | 75/415 |

FOREIGN PATENT DOCUMENTS 4426627 2/1995 Germany .

*Primary Examiner*—Paul Thibodeau
*Assistant Examiner*—Holly C. Rickman
*Attorney, Agent, or Firm*—Jordan and Hamburg LLP

[57] ABSTRACT

A component, particularly for land vehicles, preferably a car body component for motor vehicles, consists of a metallic foam material with a foamed porous layer comprising a metal powder and a blowing agent and possibly at least one solid metal sheet, there being metallic bonds between the solid metal sheet and the foamed porous layer. The component has at least one stamped contour which is raised from its surface, the angles, occurring in the region of the transitions between the three-dimensionally molded contour and the surface region being of the order of 100° to 180°. To produce the component, an essentially flat, metallic foam material, which is provided with solid metal sheets as covering layers, is initially shaped into a semi-finished molded product, which is end-contoured on one side, and the semi-finished molded product, so formed, is placed into a foaming mold, one wall of which is adapted to the end-contoured side of the semi-finished molded product, and foamed therein.

32 Claims, 5 Drawing Sheets

COMPONENT MADE FROM A METALLIC FOAM MATERIAL

BACKGROUND OF THE INVENTION

The invention relates to a component made from a metallic foam material and to a method for providing the final shape of a component, formed from an essentially two-dimensional metallic foam material as well as apparatuses for carrying out the method.

Metallic foam materials, which contain either a foamable layer comprising only a metal powder and a blowing agent or a layer, which comprises a foamable metal powder and blowing agent and is provided with at least one solid metal sheet as covering layer, there being metallic bonds between the solid metal sheet and the foamable layer, are known.

German 41 01 630 A1 discloses how, starting from a metallic powder, to which a blowing agent powder that splits off gas, preferably a metal hydride, is added, a foam material is formed which, after thorough mixing, is exposed to a high pressure and a high temperature, which can be attained, for example, by a hot rolling operation, and subsequently is cooled, so that a foamable semi-finished product is obtained.

German 44 26 627 A1 discloses the production of a material with a foamable layer, which consists of a metal powder and a blowing agent and is bounded by at least one solid metallic covering layer. For two-dimensional composite materials of this type, it is suggested that the different layers be connected by roll-bonded cladding, as a result of which a flat laminate results, which is to be foamed after it is provided with a final shape.

The methods introduced for producing suitable foam materials do not indicate any possibility of forming mass produced components in a reproducible manner from the materials made available.

SUMMARY OF THE INVENTION

It is an object of the invention to produce metallic, lightweight components for a constant, dimensionally accurate, serial production, particularly in vehicle construction, from two-dimensional foam materials of the initially described type.

The inventive component meets all essential geometric requirements, imposed by the construction of automobile bodies and vehicles on two-dimensional metallic components. By constructing the transition angles between 100° and less than 180°, it is achieved that the structure of the foamed layer is not interrupted, retracted or thinned in the region of the transitions, so that the mechanical stability and the dimensional accuracy of the component is maintained over its whole region.

An inventive component has a very low weight. At the same time, the stiffness is high, particularly in the case of multilayer composites, so that such components can be used in the load-bearing region of a car body, as well as for lining and shielding purposes.

Components, which consist only of a foamed, porous layer comprising a metal powder and a blowing agent, a so-called integral foam, can be used, in particular, as crash elements. Due to the cellular structure of the foamed materials, the energy-absorbing capability, when the component is shaped, is very good. Due to the inventive construction of the component, it is possible to shape it before it is foamed, so that it can be used, for example, as an inner layer of a bumper made, for example, from plastic.

Components, which comprise a foamed metallic layer, which is provided on one side with a solid metallic covering layer, are suitable for forming very light and very stiff components, such as, a vehicle roof, which does not require a stiffening substructure.

Materials, which have a foamed layer and, on either side, are clad with solid sheet metal, are suitable for producing components, which on either side have a smooth surface, which absorbs tensile and compressive forces, for example, for the transverse rear wall of a vehicle. At the same time, the foamed layer assumes the function of a spacer as well as the transfer of shear forces. Such a component also has a high stiffness, a low weight, is suitable for absorbing high energies, as in an accident and, moreover, is a good sound insulator.

The foamed layer usually consists of a metal powder based on aluminum, with alloyed portions of, for example, silicon. The mechanical properties of the components can be adjusted by selecting suitable alloying elements and suitable proportions of these alloying elements. Light metal alloys can also be used for the solid metal sheets.

Further advantages arise out of the accompanying drawings and the following description of the component and of its manufacturing method.

DESCRIPTION OF THE PREFERRED EMBODIMENTS

Figure 1:
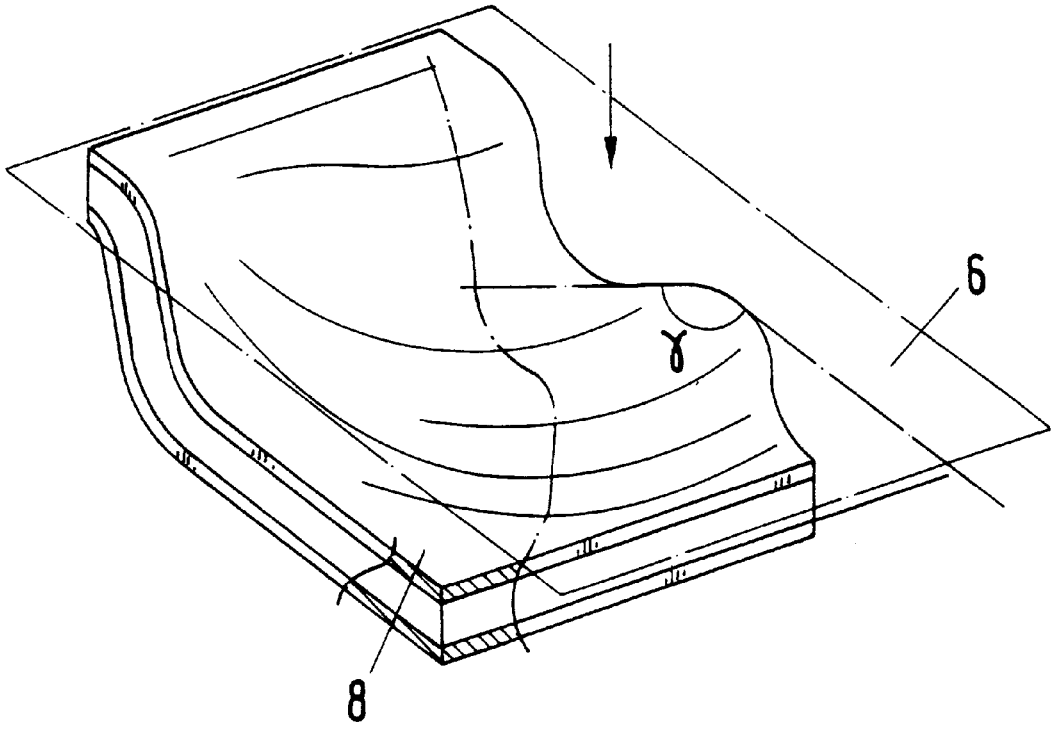
FIG. 1 shows, in diagrammatic view at an angle from above, a deep-drawing mold, on which a foam material, which is to be shaped, is placed.
Figure 2:
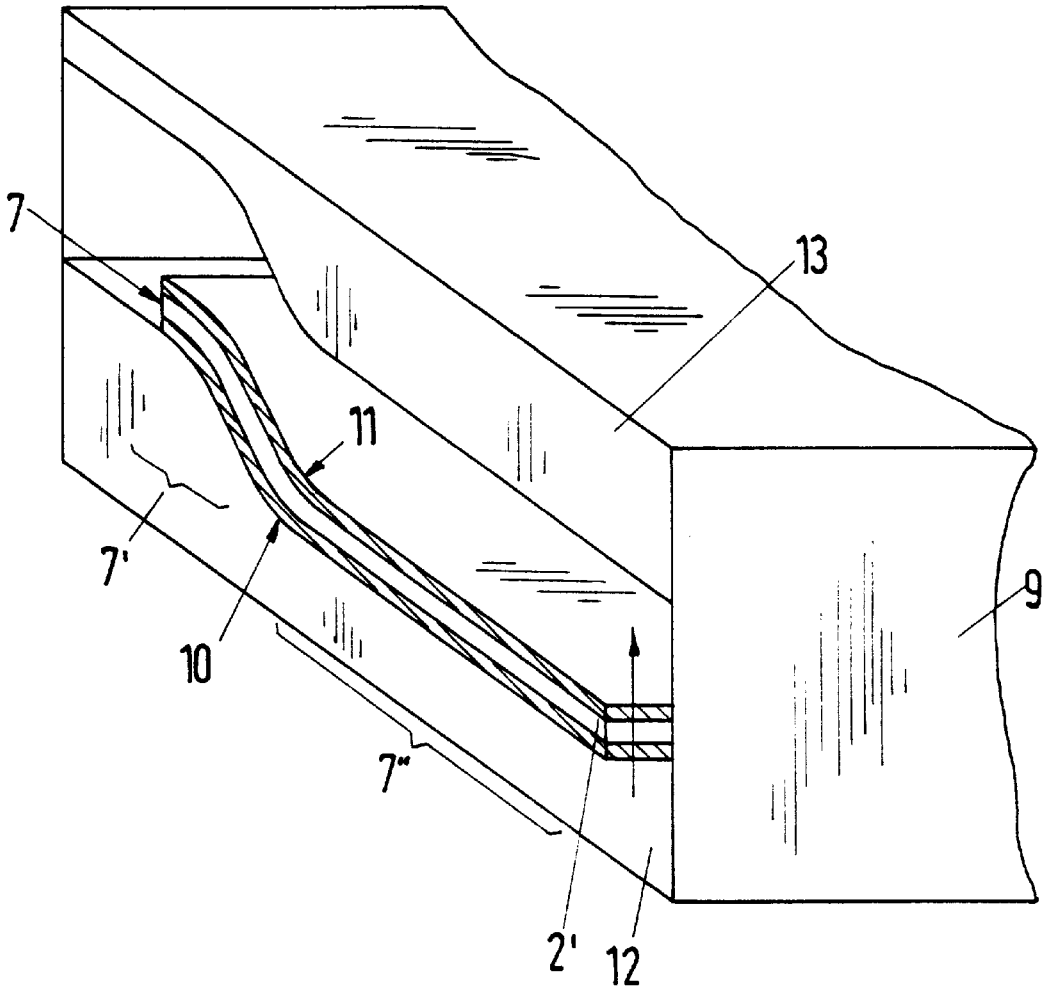
FIG. 2 shows a semi-finished molded product, inserted in a foaming mold and end-contoured on one side, in a diagrammatic, perspective view.
Figure 3:
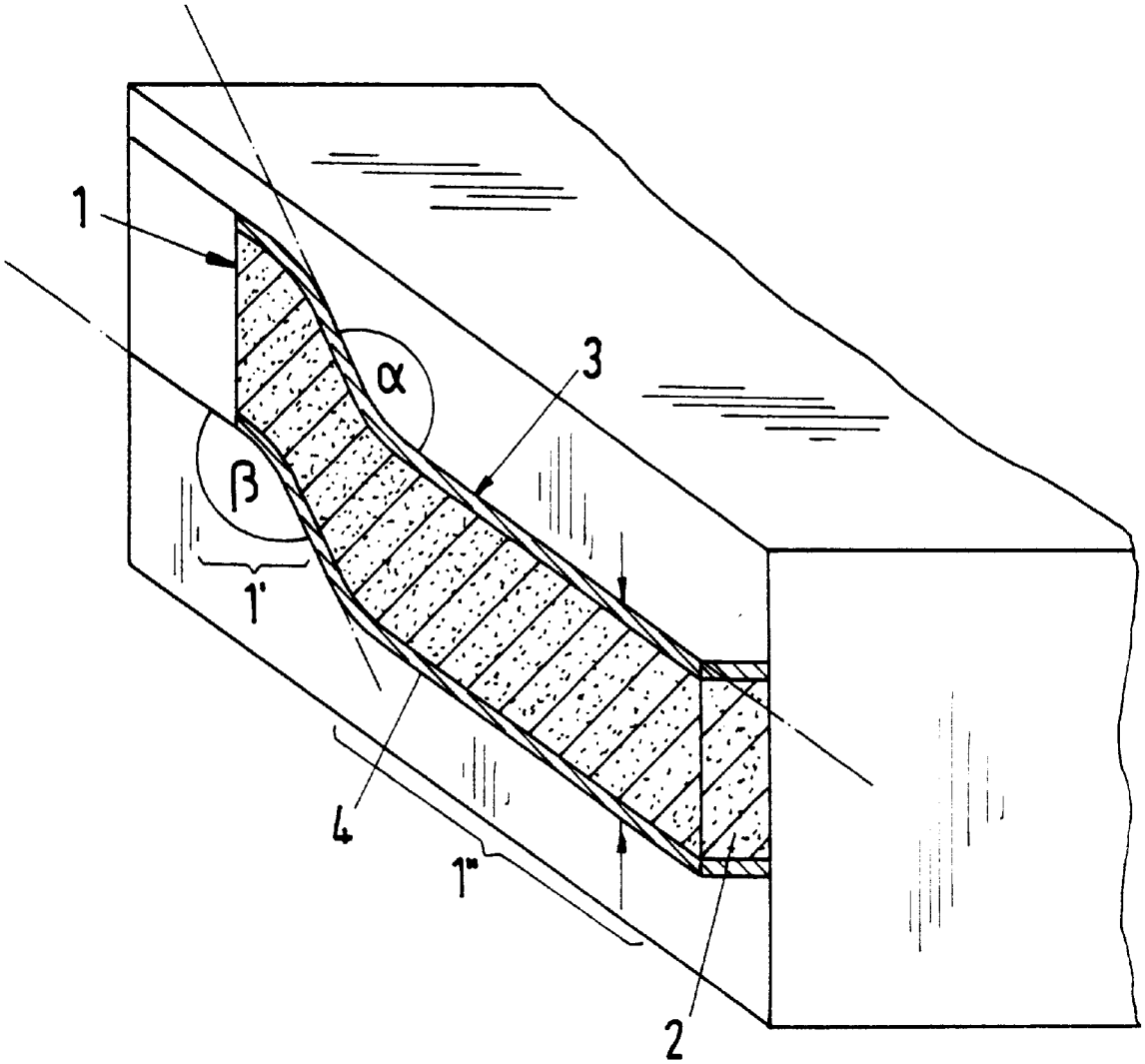
FIG. 3 shows a similar view of the component at the end of the foaming process.
Figure 4:
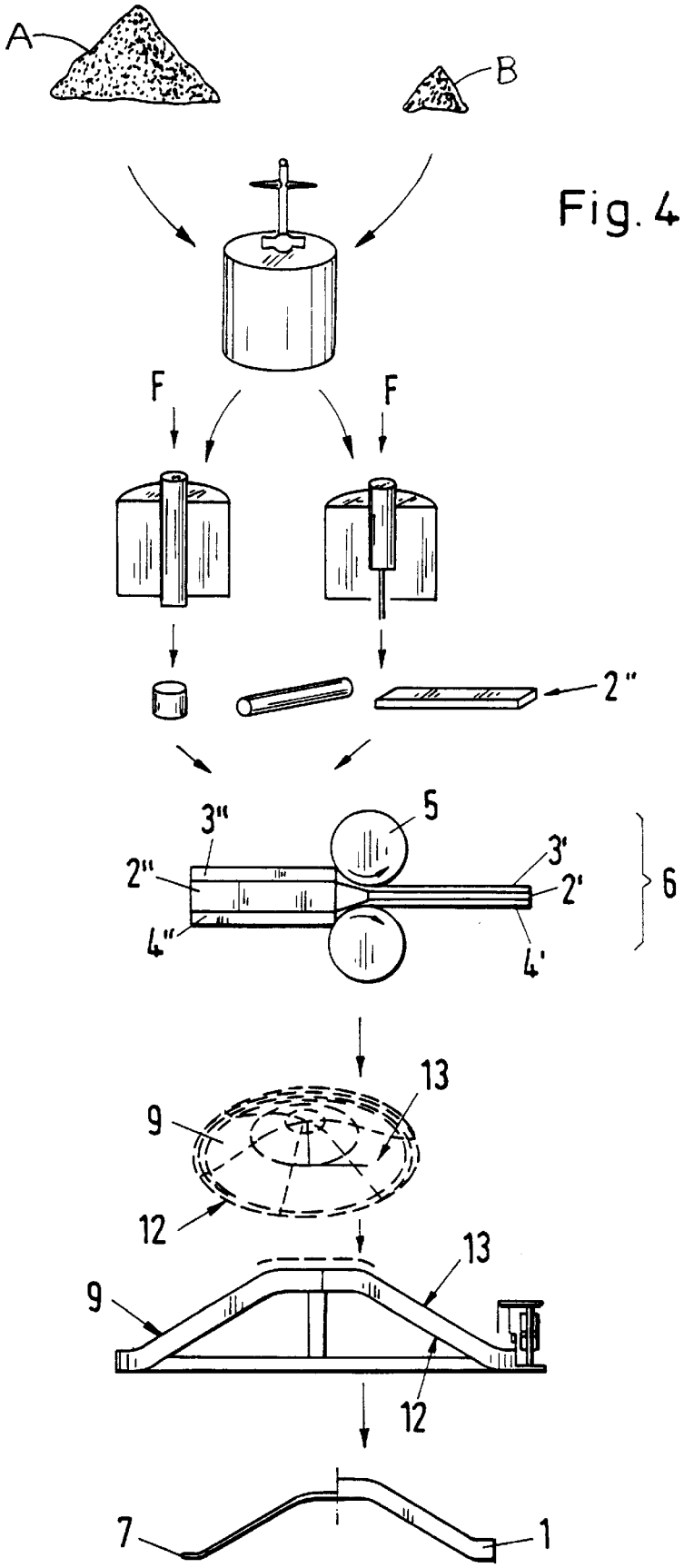
FIG. 4 shows the whole of the manufacturing method of an inventive component in a diagrammatic overview.
Figure 5:
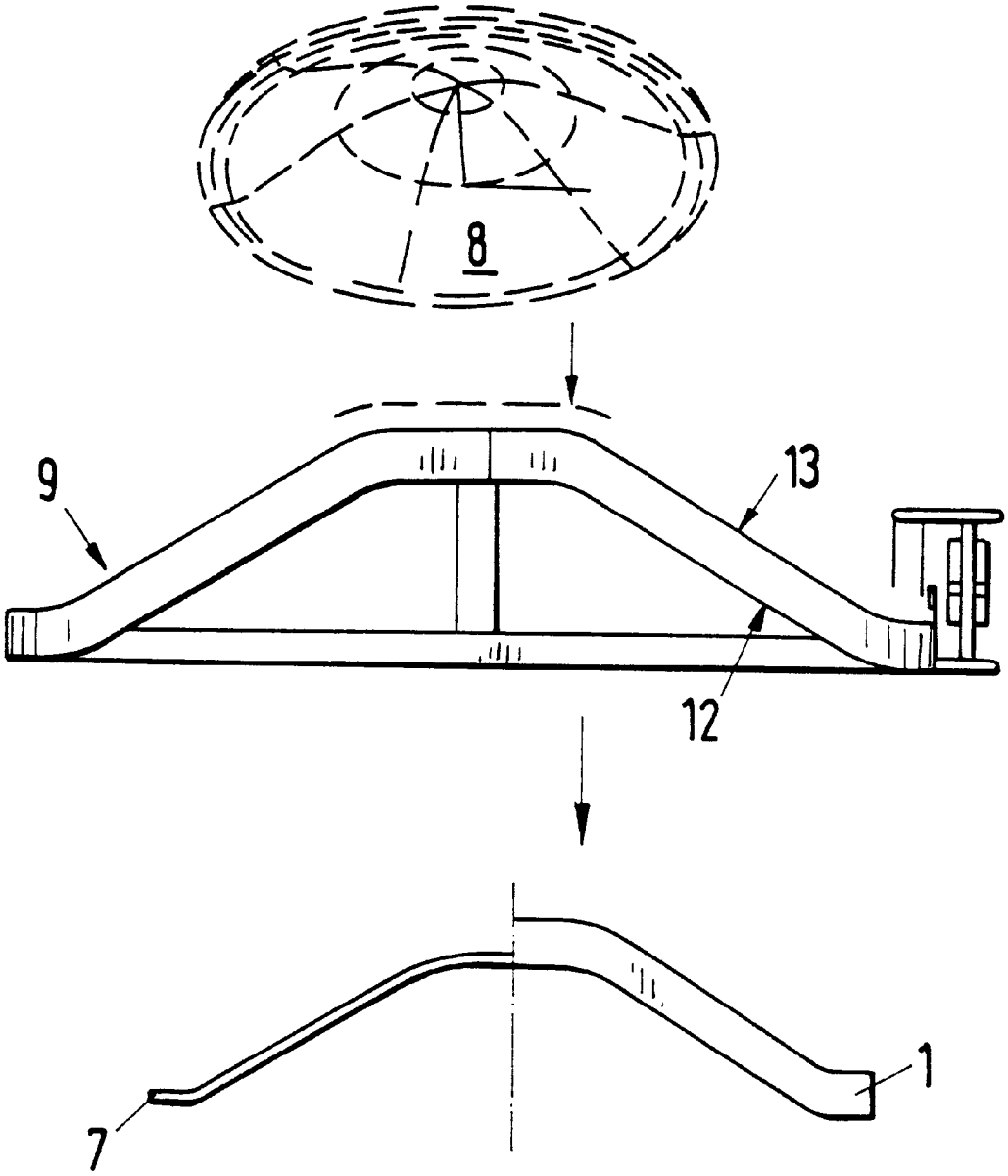
FIG. 5 shows the inventive foaming of the component in a diagrammatic representation of the various steps.

The inventive component 1 has a foamed-on layer 2, which comprises a metal powder and a blowing agent, as shown at A and B respectively in FIG. 4, which were mixed homogeneously together in a mixing process and subsequently consolidated and hardened by the action of pressure, for example, by axially pressing or by extrusion, into a compact, foamable semi-finished product 2".

In the example shown, the foamed layer 2 is provided above and below in each case with a solid metal sheet 3, 4 which, however, is not essential and, particularly for the construction of an inventive component 1 as a crash element, can be omitted. It is furthermore possible to combine a foamed layer 2 with only one solid metal coating layer 3 and/or 4 or also to produce a composite of several different foamed layers, possibly separated by solid metal layers, in order to produce, for example, collision elements, in which, depending on the impact speed and with that, the impact energy, a different number of foamed layers participate in the deformation due to the impact.

In the example of a foamed layer 2, provided on both sides with solid metal sheets 3 and 4, the connection between the layer 2 foamed on at the end of the method, and the solid metal sheets 3 and 4, is brought about under the action of pressure in such a manner, that a metallic bond is attained between the layers 2', 3', 4' before the molding and foaming. For this purpose, a composite of the foamable semi-finished product 2", which is formed by extrusion or axial pressing, is roll-bonded onto the solid metal sheets 3", 4" between two rollers 5, so that a composite material 6 with a sandwich structure of two solid metal covering layers 3' and 4' and a not yet foamed porous intermediate layer 2' results.

Such an essentially two-dimensional, metallic composite material 6, which in every case comprises a layer 2', which is still to be foamed, has metallic bonds between the metal sheets 3' and 4' and the foamable layer 2' and is now available for further processing. This two-dimensional composite material 6 initially is divided into pieces of a suitable size, for example, with the help of a saw.

Such a composite material 6, cut to the desired external dimensions, is now molded into a semi-finished molded product 7. The molding can bring about a continuous curvature of the composite material 6, as well as the stamping of individual regions 7'.

In every case, the mold 8, used for molding the composite material 6 into a semi-finished molded product 7, makes an angle γ, which ranges in magnitude from 100° to 260°, with the supporting surface of the composite material 6, the edges being rounded off in order to avoid a direct beveling of the composite material 6. As a result, the bond is maintained even in the angular regions and the mechanical strength of the semi-finished molded product 7, obtained by the molding, has no punctual weaknesses.

The molding can be accomplished by the usual molding procedures, such as deep drawing with and without holding-down clamps, as employed by manufacturers of car bodies, or by a one-sided molding procedure, such as the fluid cell method.

In every case, a semi-finished molded product 7 is obtained, which contains either flat or curved surface regions 7" and possibly contours 7' molded from these and which includes a foamed-on layer 2' for the further processing.

The foaming of the semi-finished molded product 7 into a component 1 in a defined, reproducible and true-to-size manner is the actual intention of the invention, because only by these measures does it become possible to make components available for mass production.

For this purpose, the semi-finished molded product 7 is placed in a foaming mold 9, and the foaming is effected in situ in the foaming mold 9. One wall 12 of the foaming mold 9 supports a side 10 of the semi-finished molded product 7 essentially over its surface, so that this side 10 must already have its final contour, since a further contouring by the foaming of the semi-finished molded product 7 into a component 1 no longer brings about any molding of this side 10.

The walls 12, 13 of the foaming mold 9 may consist, for example, of steel or also of ceramic. In any case, it is important that the component 1, despite the internal pressure existing during the foaming, does not enter into any bonding with the walls 12, 13 of the foaming mold 9. These walls 12, 13 may be coated in order to prevent any adhesion.

The two-dimensional support of an end-contoured side 10 of the semi-finished molded product 7, which has not yet been foamed, prevents deformation towards the outside of this side 10, which already has the final contour of the later component 1, during the foaming by the pressure of the gas-emitting blowing agent in the foaming layer 2'. At the same time, it is advantageous and essential for many applications to assign a further wall 13 of the foaming mold 9 to the opposite side 11 of the semi-finished molded product 7. This wall 13 is disposed at a fixed distance from the wall 12 in order to limit by these means the extent of the expansion of the foaming layer 2' and thus to assure the dimensional accuracy of the finished component 1 with a deviation of less than 5 to 10 mm. Because of the adjustability of the distance between the walls 12, 13, the thickness of the component 1 and, with that, also its density and mechanical strength, can be pre-selected. As a result, it is achieved that the same starting material can be used for components 1 with completely different properties. The longer the permitted foaming path in the foaming mold 9, the lower is the density of the finished component 1. The stiffness of component 1 can also be adjusted in this manner. By these means, the different stiffness requirements of a short passenger car roof and of a long roof of a station wagon can be fulfilled by the degree of foaming.

The upper wall 13 of the foaming mold can be omitted if the thickness of the semi-finished molded product, which is to be foamed, does not have to be very accurate dimensionally as, for example, in the case of crash elements.

In most cases, however, the foaming path and, with that, the final dimensions of the foamed component 1 must be limited by two walls 12 and 13, so as to make it possible to mass produce components 1, which are always foamed in the same way.

The two opposite walls 12 and 13 of the foaming mold 9 have essentially parallel surface structures, since it is not possible to make further structures by the foaming process in only one surface 11 of the semi-finished molded product 7, for example by providing recesses in the bounding wall 13 of the foaming mold 10.

By a foaming procedure, which is so defined, components 1 are obtained as mass produced, lightweight construction products, which can be used, for example, as car body inside panels, as front walls or as partitions for the engine compartment or the trunk or for crash-protection and stiffening purposes within the car body.

Such components can be curved overall, for example, for use as outer door panels, or comprise stamped contours 1', which are made from flat or curved regions 1" which, in the region of the transitions, form angles α of the order of 100° to 180° with the curved or flat surface region, so that, by these means, the different requirements of car body panels and car body inside panels can be fulfilled with very light and distortion-resistant components 1.

Likewise, within the stamped contours 1', angles β of the same of order of magnitude can occur so that here also there is maximum flexibility and adaptability to the demands of the car body manufacturer.

With the method introduced here and the therefrom resulting components, it is possible, for the first time, to use materials of metallic foams—and possibly of solid metallic sheets, which are combined with these foams—for mass production and to put into practice the advantages offered by such a lightweight construction, in a reproducible manner, by known molding processes and a subsequent defined foaming of the layer 2', containing the metal powder and blowing agent.

What we claim is:

1. A method for forming a shaped component comprising:

forming a composite of metal foam material from a metal powder mixed with a blowing agent;

providing a solid metal body;

pressing one side of said solid metal body against one side of said composite;

effecting a bond between said one side of said solid metal body and said one side of said composite as a result of said pressing to thereby form a generally flat semi-finished product;

shaping said semi-finished product into a desired configuration in which said solid metal body has a shaped external surface conforming to said desired configuration, said shaped external surface having a contour portion having an angle of less than 180 degrees;

maintaining said bond between said one side of said metal body and said one side of said composite during and after completion of said shaping step;

providing a first mold surface having a configuration conforming to the configuration of said shaped external surface of said solid metal body;

placing said shaped external surface of said solid metal body on said first mold surface in conforming engagement with said first mold surface;

providing a second forming mold surface having a configuration conforming generally to the configuration of said shaped external surface of said solid metal body;

positioning said second mold surface in a superimposed and generally parallel relationship with said first mold surface;

said positioning step including positioning said second mold surface in a position spaced from said composite;

foaming said composite of metal foam material;

expanding said composite of foam material in a direction away from said one side of said solid metal body while maintaining a conforming relationship between said shaped external surface of said solid metal body and said first mold surface;

utilizing said second mold surface to limit the expansion of said composite by effecting engagement between said composite and said second mold surface to thereby obtain an expanded structure of constant thickness; and removing said expanded structure from said first and second mold surfaces to thereby obtain a finished product having a first outer boundary formed by said shaped external surface of said solid metal body and a second outer boundary formed by said composite and conforming generally to the configuration of said second mold surface and in which the expanded composite of metal foam material is bonded to the solid metal body and the composite of metal foam material has a uniform integrity of cell structure.

2. A method according to claim 1 wherein said step of shaping said semi-finished product into a desired configuration comprises shaping said semi-finished product into a shape encompassing about 100 degrees to less than 180 degrees.

3. A method according to claim 2 wherein said component has a dimensional accuracy of less than 10 mm.

4. A method according to claim 3 wherein said component has a dimensional accuracy of less than 5 mm.

5. A method according to claim 1 further comprising the step of obtaining a desired density of said foamed composite in said product by varying the size of the spacing between said first and second mold surfaces.

6. A method according to claim 1 further comprising the step of obtaining a desired strength of said foamed composite in said product by varying the size of the spacing between said first and second mold surfaces.

7. A method according to claim 1 further comprising dividing said semi-finished product into a plurality of sub-structures, and performing said shaping step and all of said steps subsequent to said shaping step separately on each sub-structure to thereby obtain a plurality of mass-produced products each having substantially the same size, structure and configuration.

8. A method according to claim 7 further comprising utilizing said mass-produced products as a component for an assembled unit.

9. A method according to claim 8 wherein said assembled unit is a motor vehicle and said mass produced product is selected from the group consisting of motor vehicle door panels, motor vehicle inside panels, motor vehicle outside panels, motor vehicle roofs, front wall partitions for an engine compartment, and partitions for a trunk.

10. A method according to claim 1 wherein said pressing step includes passing said solid metal body and said composite between pressing members.

11. A method according to claim 1 wherein said pressing step includes extruding said metal body and said composite.

12. A method according to claim 1 wherein said shaping step includes stamping said semi-finished product into said desired configuration.

13. A method for forming a component comprising:

forming a composite of metal foam material from a metal powder mixed with a blowing agent;

providing a first and second solid metal body;

pressing one side of said first solid metal body against a first side of said composite and one side of said second solid metal body against a second side of said composite;

effecting a bond between said one side of said first solid metal body and said first side of said composite and between said one side of said second metal body and said second side of said composite as a result of said pressing to thereby form a semi-finished product;

shaping said semi-finished product into a desired configuration, said first and second solid metal bodies of said semi-finished product each having a shaped external surface conforming to said desired configuration, each of said shaped external surfaces having a contour portion having an angle of less than 180 degrees, said shaped external surfaces of said first and second bodies being generally parallel to one another;

maintaining said bond between said one side of said first metal body and said first side of said composite and between said one side of said second metal body and said second side of said composite during and after completion of said shaping step;

providing a first mold surface having a configuration conforming to the configuration of said shaped external surface of said first solid metal body;

placing said shaped external surface of said first solid metal body on said first mold surface in conforming engagement with said first mold surface;

providing a second forming mold surface having a configuration conforming generally to the configuration of said shaped external surface of said second solid metal body;

positioning said second mold surface in a superimposed and in a generally parallel relationship with said first mold surface;

said positioning step including positioning said second mold surface in a position spaced from said second metal body;

foaming said composite of metal foam material;

expanding said composite foam material in a direction away from said one side of said first solid metal body while maintaining a conforming relationship between said shaped external surface of said first solid metal body and said first mold surface;

effecting translatory movement of said second solid metal body toward said second mold surface during said step of expanding said composite foam material;

utilizing said second mold surface to limit the expansion of said composite foam material by effecting engagement between said second solid metal body and said second mold surface to obtain an expanded structure of constant thickness; and removing said expanded structure from said first and second mold surfaces to thereby obtain a product having outer boundaries formed by said shaped external surfaces of said first and second solid metal bodies and in which the expanded composite of metal foam material is bonded to the first and second solid metal bodies and the composite of metal foam material has a uniform integrity of cell structure.

14. A method according to claim 13 wherein said step of shaping said semi-finished product into a desired configuration comprises shaping said semi-finished product into a shape encompassing about 100 degrees to less than 180 degrees.

15. A method according to claim 13 wherein said component has a dimensional accuracy of less than 10 mm.

16. A method according to claim 13 wherein said component has a dimensional accuracy of less than 5 mm.

17. A method according to claim 13 further comprising the step of obtaining a desired density of said foamed composite in said product by varying the size of the spacing between said first and second mold surfaces.

18. A method according to claim 13 further comprising the step of obtaining a desired strength of said foamed composite in said product by varying the size of the spacing between said first and second mold surfaces.

19. A method according to claim 13 further comprising dividing said semi-finished product into a plurality of sub-structures, and performing said shaping step and all of said steps subsequent to said shaping step separately on each sub-structure to thereby obtain a plurality of mass-produced products each having substantially the same size, structure and configuration.

20. A method according to claim 19 further comprising utilizing said mass produced products as a component for an assembled unit.

21. A method according to claim 20 wherein said assembled unit is a motor vehicle, and said mass-produced product is selected from the group consisting of motor vehicle door panels, motor vehicle inside panels, motor vehicle outside panels, motor vehicle roofs, front wall partitions for an engine compartment, and partitions for a trunk.

22. A method according to claim 13 wherein said pressing step includes passing said first and second solid metal bodies and said composite between pressing members.

23. A method according to claim 13 wherein said pressing step includes extruding said first and second solid metal bodies and said composite.

24. A method according to claim 13 wherein said shaping step includes stamping said semi-finished product into said desired configuration.

25. A method for forming a component comprising:

forming a composite of metal foam material from a metal powder mixed with a blowing agent;

providing a solid metal body;

pressing one side of said composite against one side of said solid metal body;

effecting a bond between said one side of said composite and said one side of said solid metal body as a result of said pressing to thereby form a generally flat semi-finished structure;

shaping said semi-finished structure into a desired configuration in which said solid metal body has a shaped external surface conforming to said desired configuration, said shaped external surface having a contour portion having an angle of less than 180 degrees;

maintaining said bond between said one side of said metal body and said one side of said composite during and after completion of said shaping step;

providing a mold surface having a configuration conforming to the configuration of said shaped external surface of said solid metal body;

placing said shaped external surface of said solid metal body on said mold surface in conforming engagement with said mold surface;

foaming said composite of metal foam material;

expanding said composite foam material in a direction away from said one side of said solid metal body while maintaining a conforming relationship between said shaped external surface of said solid metal body and said mold surface to obtain an expanded structure; and removing said expanded structure from said mold surface to thereby obtain a product having an outer boundary formed by said shaped external surface of said solid metal body and in which the expanded composite of metal foam material is bonded to the solid metal body and the composite of metal foam material has a uniform integrity of cell structure.

26. A method according to claim 25 wherein said step of shaping said semi-finished product into a desired configuration comprises shaping said semi-finished product into a shape encompassing about 100 degrees to less than 180 degrees.

27. A method according to claim 25 further comprising dividing said semi-finished product into a plurality of sub-structures, and performing said shaping step and all of said steps subsequent to said shaping step separately on each sub-structure to thereby obtain a plurality of mass-produced products each having substantially the same size, structure and configuration.

28. A method according to claim 25 further comprising utilizing said mass-produced products as a component for an assembled unit.

29. A method according to claim 25 wherein said assembled unit is a motor vehicle, and said mass-produced product is selected from the group consisting of motor vehicle door panels, motor vehicle inside panels, motor vehicle outside panels, motor vehicle roofs, front wall partitions for an engine compartment, and partitions for a trunk.

30. A method according to claim 25 wherein said pressing step includes passing said solid metal body and said composite between pressing members.

31. A method according to claim 25 wherein said pressing step includes extruding said metal body and said composite.

32. A method according to claim 25 wherein said shaping step includes stamping said semi-finished product into said desired configuration.

* * * * *